US005967749A

United States Patent [19]

Eaves et al.

[11] Patent Number: 5,967,749

[45] Date of Patent: Oct. 19, 1999

[54] CONTROLLABLE PITCH PROPELLER ARRANGEMENT

[75] Inventors: Stephen Eaves, Charlestown, R.I.; James S. Smith, Old Lyme, Conn.

[73] Assignee: Electric Boat Corporation, Groton, Conn.

[21] Appl. No.: 09/004,433

[22] Filed: Jan. 8, 1998

[51] Int. Cl.[6] ..... F03G 7/00; B63H 1/06

[52] U.S. Cl. ..... 416/3; 416/155

[58] Field of Search ..... 416/3, 147, 149, 416/155, 170 R

[56] References Cited

U.S. PATENT DOCUMENTS

| | | | |
|---|---|---|---|
| 2,909,229 | 10/1959 | Cross et al. | 416/147 |
| 3,708,251 | 1/1973 | Pierro . | |
| 3,785,747 | 1/1974 | Mayo, Jr. . | |
| 3,914,629 | 10/1975 | Gardiner | 310/46 |
| 4,563,622 | 1/1986 | Deavers et al. | 416/170 R X |
| 4,634,343 | 1/1987 | Nakamats | 416/3 |
| 4,648,345 | 3/1987 | Wham et al. | 416/3 X |
| 4,722,668 | 2/1988 | Novacek | 416/3 X |
| 4,831,297 | 5/1989 | Taylor et al. . | |
| 5,185,545 | 2/1993 | Veronesi et al. | 310/114 |
| 5,211,539 | 5/1993 | Mccerty | 416/147 X |
| 5,252,875 | 10/1993 | Veronesi et al. | 310/114 |
| 5,306,183 | 4/1994 | Holt et al. . | |

FOREIGN PATENT DOCUMENTS

| | | | |
|---|---|---|---|
| 53-23498 | 3/1978 | Japan | 416/3 |

*Primary Examiner*—John E. Ryznic
*Attorney, Agent, or Firm*—Baker & Botts LLP

[57] ABSTRACT

In the particular embodiments described in the specification, a controllable pitch propellor arrangement includes a plurality of propellor blades supported from a central hub which is rotatably mounted on a shaft in which each blade is pivotally supported from the central hub. Two radial pins extending from the outer ends of each of the blades are received in corresponding rims having peripherally disposed permanent magnet arrays. The rims are rotated to drive the propellor by energization of coils in a stator assembly surrounding the rims and the pitch of the blades is changed by changing the phase relationship of the current supplied to the stator coils to change the angular relation of the rims.

9 Claims, 4 Drawing Sheets

CONTROLLABLE PITCH PROPELLER ARRANGEMENT

BACKGROUND OF THE INVENTION

This invention relates to controllable pitch propellor arrangements for energy conversion between electrical energy and fluid energy.

Controllable pitch control of propellers or turbine blades is commonly used to improve operating efficiency and flexibility particularly in the marine industry. For such applications, conventional controllable pitch propellers or turbines have blades mounted on a hollow support shaft and include a complex actuation mechanism extending through the hollow shaft. Typical arrangements for rotating the blades of this type are disclosed in U.S. Pat. Nos. 3,785,747 and 4,648,345.

Also, shaftless pumps are known in various industries in which propellor blades are affixed to a driven rim. This provides the advantage of reducing restriction or disruption to the flow of fluid to the propeller blades which can occur when the blades are driven by a propellor shaft. Such arrangements are disclosed in U.S. Pat. Nos. 3,708,251; 3,914,629; 4,831,297; 5,185,545; 5,252,857 and 5,306,183.

U.S. Pat. No. 2,909,229 discloses a reversible pitch fan having fan blades connected to two rims which can be angularly shifted between two positions by stressing the blades or the rims to reverse to the blowing direction of the fan to remove dust and debris from radiators. The blades are retained in either of the two positions by resilience of the blades or the rims.

SUMMARY OF THE INVENTION

Accordingly, it is an object of the present invention to provide a controllable pitch propellor arrangement which overcomes disadvantages of the prior art.

Another object of the invention is to provide a controllable pitch propellor arrangement in which the propellor pitch can be varied by a simple and efficient arrangement providing improved reliability through the elimination of moving parts and shaft seals.

These and other objects of the invention are attained by providing a propellor having blades which are supported at their inner ends at a central hub and which are supported at the outer ends for angular motion by engagement with at least two separately movable rims so that, by varying the angular relation between the rims, the angular orientation of the outer ends of the blades is changed. In one embodiment the outer ends of the blades are attached to the rims by pins which permit relative angular motion between the blade and the rims. The rims also contain permanent magnets distributed around their circumference so that they can be rotated separately by appropriate actuation of windings in a stator surrounding the rims. By varying the phase relationship between the currents supplied to the stator windings, the relative angular positions of the rims can be altered, thereby controlling the pitch of the blades which are connected to the rims.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
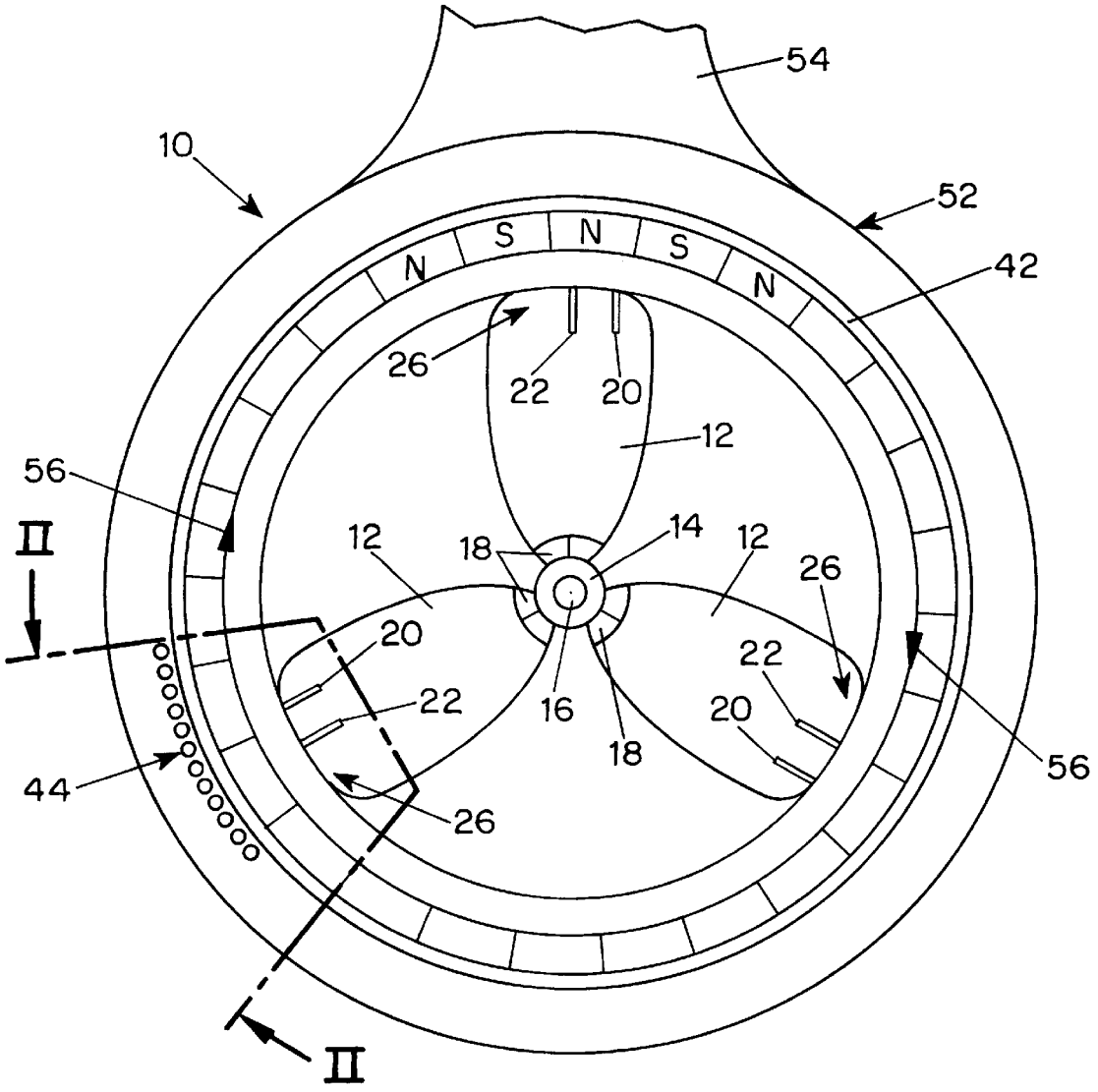
FIG. 1 is a side view, partly in section, illustrating a representative embodiment of a controllable pitch propellor arrangement in accordance with the invention.
Figure 2:
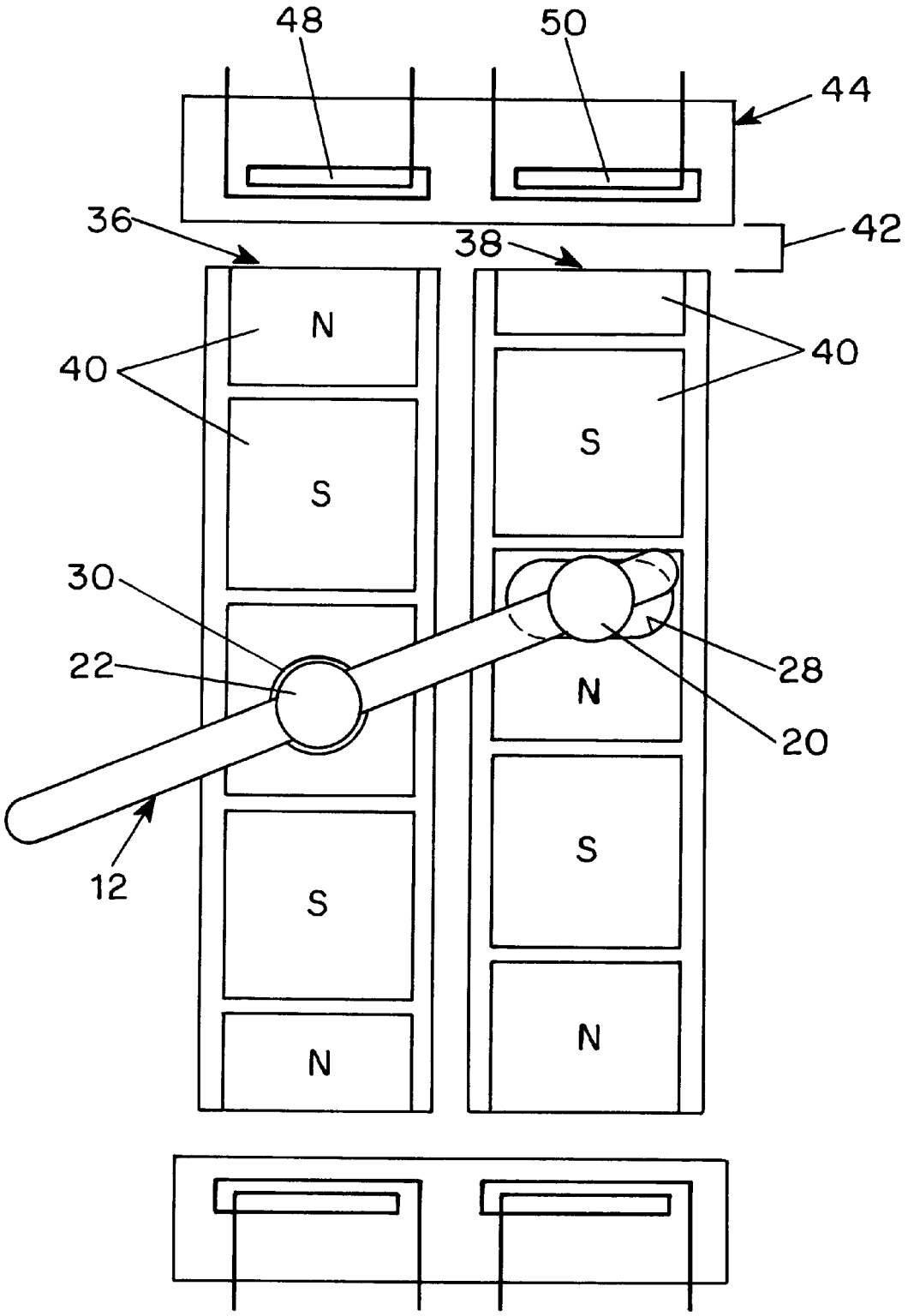
FIG. 2 is a fragmentary sectional view taken along the line II—II of FIG. 1 and looking in the direction of the arrows.

In the typical embodiment of the invention illustrated in the drawings, a controllable pitch propellor arrangement 10 includes three blades 12 which are supported at their inner ends by a hub 14 rotatably mounted on a central shaft 16 as shown in FIG. 1. In this embodiment, the blades 12 are pivotally connected to the hub 14 by corresponding pivotal connections 18. Two radial pins 20 and 22 are mounted at the outer end 26 of each blade so as to project beyond the blade and be received in corresponding openings 28 and 30 in two rims 36 and 38 as shown in FIG. 2. The opening 30 in the rim 36 is circular and the central pin 22 at the tip 26 of the blade 12 fits closely within that opening so as to permit angular motion but not lateral motion of the blade with respect to the rim 36. The opening 28, on the other hand, has a lateral slot permitting both rotation and lateral motion of corresponding pin 20 with respect to rim 38. As a result, the pitch of each blade 12 can be changed by shifting the rim 38 angularly in opposite directions with respect to the rim 36.

In order to accomplish this, the periphery of each of the rims 36 and 38 has a plurality of permanent magnets 40 arranged so that the north and south poles N and S of the magnets are alternately presented in the radial direction to the peripheral surface surrounding the rotors 36 and 38. Separated from the permanent magnets 40 by a small gap 42 is a stator 44 having arrays of coil windings 48 and 50 at locations corresponding to the positions of the magnets in the rims 36 and 38 as shown in FIG. 2. The stator 44 is contained in a housing 52 which encloses the propellor arrangement and is supported by a connecting member 54 from a vehicle such as a ship to be propelled by operation of the propellor arrangement.

Figure 4:
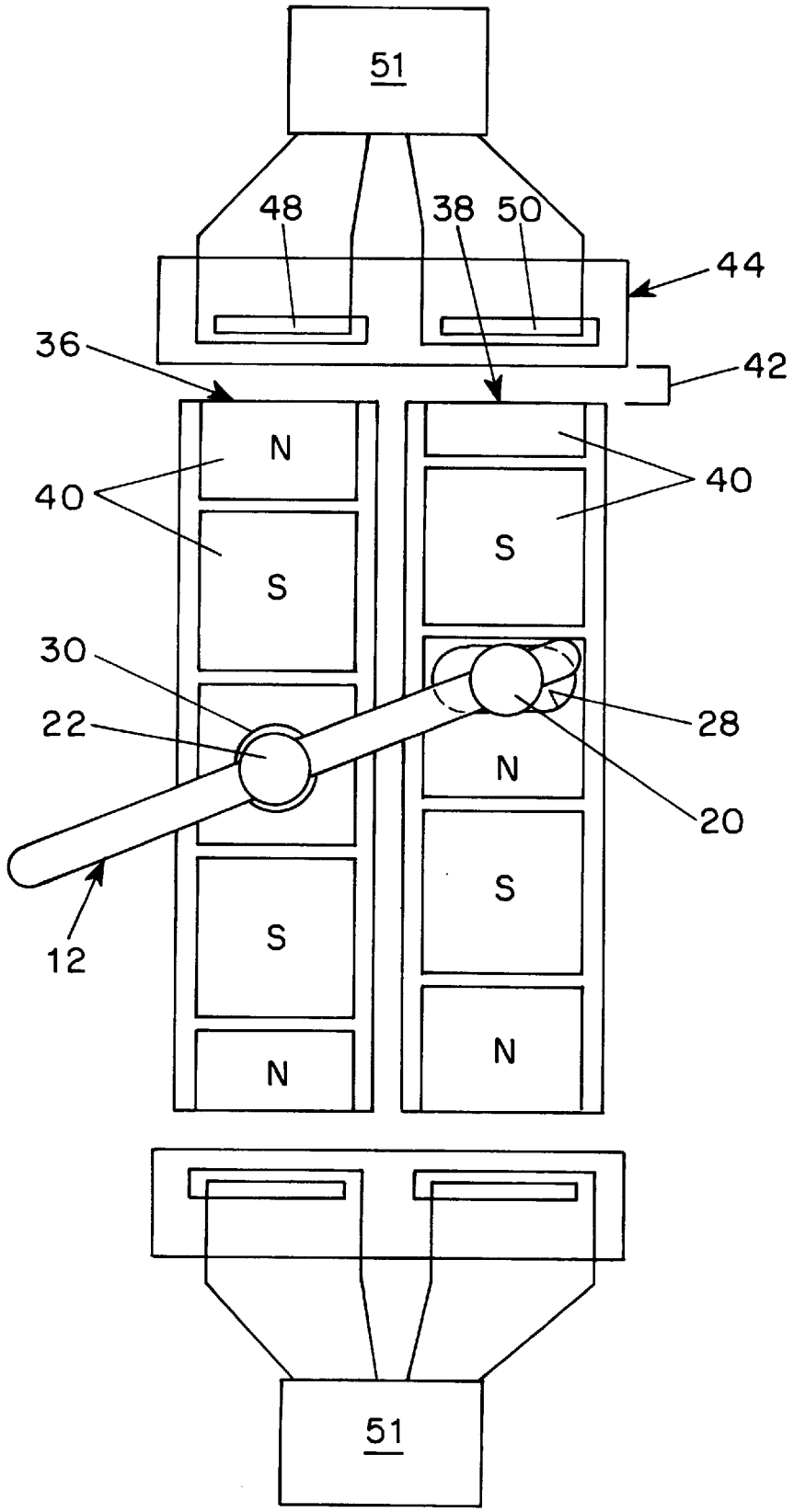
FIG. 4 is an illustration of the embodiment in FIG. 1 further including a power source.

In order to operate the propeller arrangement as shown in FIG. 4, electrical excitation 51 is provided to the separate stator rim windings 48 and 50 in such manner that they not only drive the two rims 36 and 38 in the direction indicated by the arrows 56 in FIG. 1 but also control the relative angular positions of the rims 36 and 38 with respect to each other in accordance with the phase relation of the currents supplied to the windings 48 and 50. Thus, by varying the phase relationship of the currents supplied to the windings 48 and 50, the relative angular positions of the rims can be altered so that the pitch of the blades 12 can be controlled in a desired manner. By placing each radial pin 22 on a radial line passing near the center of lift of the corresponding propeller blade, the majority of thrust-producing torque can be distributed to the rim 36, and a relatively small portion of torque will be distributed to the rim 38. This provides the advantage of using the rim 36 as the power rim for direct connection to a large source or sink of energy while the rim 38 can be made the control rim which can be connected to a relatively low power electronic speed control to control blade pitch. During low power operation, the power to the rim 36 can be removed and the propeller can be turned entirely by the rim 38 which would default to its maximum pitch limit by contacting a mechanical stop arrangement.

Figure 3:
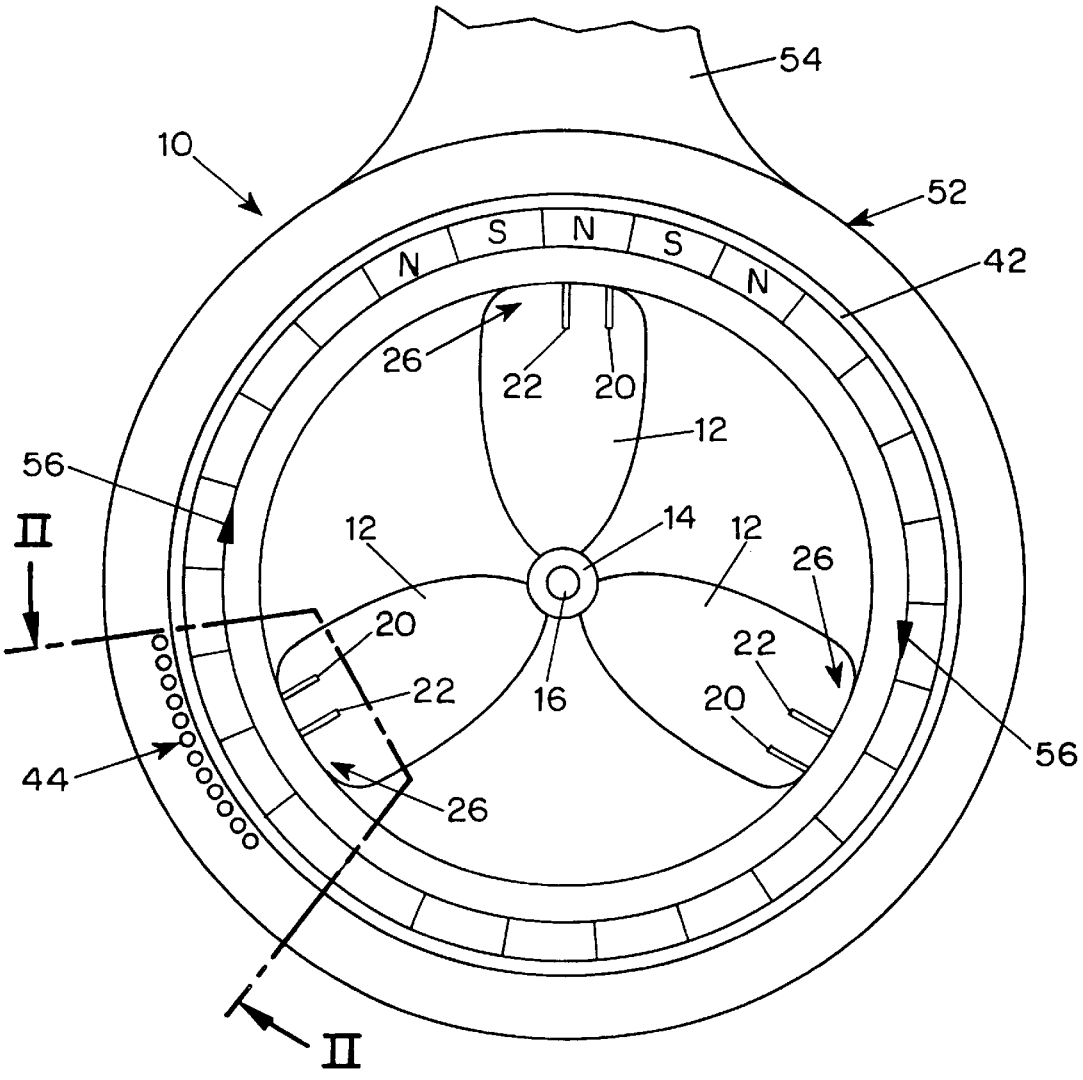
FIG. 3 is a side view, partly in section, illustrating a representative embodiment of a controllable pitch propeller arrangement having flexible blades which are rigidly supported from a central hub.

In an alternative arrangement as shown in FIG. 3, each of the blades 12 is made of a resiliently deformable material and the blades are supported from the hub 14 by rigid connections rather than pivotable supports. As a result, varying the phase relationship of the rims 36 and 38 with respect to each other causes the blades to twist, producing a blade pitch which varies along the length of the blades, which is advantageous in certain applications.

Moreover, the controllable pitch propeller arrangement of the invention can be used as a turbine generator rather than as a drive device by passing liquid through the housing 52 to force the blades 12 to rotate about the shaft 16, thereby generating current in the stator windings 48 and 50. In this case as well, the phase relation of the current in the windings 48 and 50 of the stator assembly can be controlled to vary the pitch of the blades 12 in accordance with the power demands imposed on the turbine generator.

Although the invention has been described herein with reference to specific embodiments, many modifications and variations therein will readily occur to those skilled in the art. For example, the number of propellor blades included in the controllable pitch propellor arrangement can be increased or decreased and three rims, rather than two, could be used to change the pitch of the blades. Alternatively, more than two rims might be used with rigidly supported resilient blades in order to vary the shape of the blades in a complex manner. In addition, the central shaft 16 might be eliminated completely by utilizing a magnetic, hydrostatic or mechanical radial bearing arrangement to suspend the rims and blades. This would have the advantage of removing flow restrictions presented by the shaft and its support structure. Furthermore, with a radial bearing and proper mechanical construction of the propeller blade/rim pin connections, the rotating hub as well as the shaft and support structure could be removed. Moreover, an induction motor in which bars are embedded in the rims to interact with the stator coils might be used in place of the permanent magnet rim configuration, which would provide cost benefits and possible control benefits because of its tolerance for rotor slip, although the motor would be less efficient. Accordingly, all such modifications and variations are included within the intended scope of the invention.

We claim:

1. A controllable pitch propellor arrangement comprising:

a stator assembly having a plurality of windings;

a plurality of radially projecting propellor blades rotatably supported within the stator assembly;

a plurality of adjacent rotatable rims surrounding the plurality of propeller blades; and pivotal connections between each of the blades and each of the rims;

wherein the windings in the stator assembly produce electromagnetic interaction with the rims to rotate the rims and blades and to change the relative positions of the rims with respect to each other so as to control the pitch of the blades.

2. A controllable pitch propellor arrangement according to claim 1 including an array of permanent magnets of alternate polarity mounted in the periphery of each rim for interaction with corresponding stator windings.

3. A controllable pitch propeller arrangement according to claim 1 including an array of bars mounted in the periphery of each rim for interaction with the stator windings.

4. A controllable pitch propellor arrangement according to claim 1 including first and second adjacent rims and wherein each blade is supported for angular motion with respect to the first rim and for both angular motion and relative lateral motion with respect to the second rim.

5. A controllable pitch propeller arrangements according to claim 1 including a central hub and wherein the plurality of radially projecting propeller blades are rotatably supported from the central hub.

6. A controllable pitch propeller arrangement according to claim 1 including a central hub and wherein the blades are made of flexible material and are rigidly supported from a central hub so that variations in the pitch of the blades produced by a change in the angular relation of the rims produces a pitch which changes along the length of the blades.

7. A controllable pitch propeller arrangement according to claim 1 wherein the stator assembly is connected to an electrical load to generate and supply electrical power thereto in response to mechanical rotation of the propeller blades.

8. A controllable pitch propeller arrangement according to claim 1 where the stator receives electrical energy and supplies electromagnetic driving force to the rims to cause the propellor blades to rotate.

9. A controllable pitch propeller arrangement according to claim 1 wherein the pivotal connections between the blades and a first one of the rims are on radial lines extending approximately through the center of lift of the blades so that the pivotal connections between the first one of the rims and the propeller blades exerts more lateral force than torsional force on the blades.

* * * * *